US005775013A

United States Patent [19]

Von Schalscha

[11] Patent Number: 5,775,013

[45] Date of Patent: *Jul. 7, 1998

[54] EXCAVATION BUCKET GRADING ATTACHMENT

[76] Inventor: Craig C. Von Schalscha, 629 Vendola Dr., San Rafael, Calif. 94903

[ * ] Notice: The term of this patent shall not extend beyond the expiration date of Pat. No. 5,596,825.

[21] Appl. No.: 789,847

[22] Filed: Jan. 28, 1997

Related U.S. Application Data

[63] Continuation-in-part of Ser. No. 346,477, Nov. 29, 1994, Pat. No. 5,596,825.

[51] Int. Cl.[6] ..... F02F 3/76

[52] U.S. Cl. ..... 37/407; 37/404; 172/701.3

[58] Field of Search ..... 37/231, 266, 404, 37/405, 407, 446; 56/400.05; 172/249, 701, 701.1, 701.3, 719; 403/334; 414/784

[56] References Cited

U.S. PATENT DOCUMENTS

| | | | |
|---|---|---|---|
| 3,942,271 | 3/1976 | George | 172/701.3 X |
| 4,077,142 | 3/1978 | Klett et al. | 172/701.3 X |
| 5,596,825 | 1/1997 | Von Schalscha | 37/407 |

*Primary Examiner*—Terry Lee Melius
*Assistant Examiner*—Robert Pezzuto
*Attorney, Agent, or Firm*—Larry D. Johnson

[57] ABSTRACT

A grading attachment for releasable attachment to an excavation bucket includes a generally V-shaped blade body portion and a blade/bucket attachment assembly, together defining a blade lateral axis and an equipment longitudinal axis. The attachment assembly provides for selective and releasable one-point adjustment of the relative distance between the bucket and blade attachment.

3 Claims, 6 Drawing Sheets

EXCAVATION BUCKET GRADING ATTACHMENT

This application is a continuation-in-part of application Ser. No. 08/346,477, filed Nov. 29, 1994 now U.S. Pat. No. 5,596,825.

BACKGROUND OF THE INVENTION

1. Field of the Invention

This invention relates generally to construction and excavation equipment and associated hardware, and more specifically to an improved grading attachment for releasable attachment to an excavation or other heavy equipment bucket.

2. Description of the Prior Art

Heavy equipment operators often need to change out the buckets on their excavation equipment in order to perform different tasks. For example, a standard bucket works well for trenching, digging, and similar activities, but is inappropriate for grading, smoothing or other earth moving activities. When it is necessary to perform both of these types of tasks on the same job, most operators have to completely shut down the excavation equipment, remove the bucket, and replace it with a separate grading blade (or vice versa). This is a laborious and time consuming task, and also requires the presence of both a bucket and blade at the job site, as well as the tools and manpower to accommodate the switch.

Accordingly, some devices have been designed in an attempt to simplify this operation. For example, Yunker et al. U.S. Pat. No. 4,208,815 discloses a straight edge for an earth-moving bucket with pockets on a plate to engage the bucket teeth. The plate extends back to overlap the bottom of the bucket, and the straight edge is held firm by bolts through the plate and bucket. The straight edge is no wider than the bucket so that it can function as a digging edge. Also, George U.S. Pat. No. 3,942,271 teaches a housing having a V-shaped cross-section adapted to be positioned over the teeth of a backhoe bucket, and secured there by lugs and a retaining bar. In addition, Jarvis U.S. Pat. No. 4,360,980 discloses an adaptor for connection with a backhoe bucket, including a blade member having an inclined plate forming a wedge into which the teeth of the bucket may be inserted, and is secured to the bucket with a ratchet, turnbuckle and clamp arrangement.

However, these and other known devices are all still relatively awkward and time-consuming to install. Furthermore, none of these known devices permit selective loose attachment of the blade when desired, enabling the blade to roll about the longitudinal axis of the equipment to match the contour of the grade.

SUMMARY OF THE INVENTION

The excavation bucket grading attachment of this invention provides an improved grading attachment for releasable attachment to a heavy equipment bucket. The apparatus includes a generally V-shaped blade body portion and a blade/bucket attachment assembly, together defining a blade lateral axis (along the width of the blade body portion at the connection with the bucket) and an equipment longitudinal axis (in line with the excavation equipment and bucket, and generally perpendicular to the blade lateral axis).

The blade/bucket attachment assembly provides for selective and releasable one-point adjustment of the relative distance between the bucket and blade attachment. This can be accomplished by connecting the bucket and blade attachment together using, inter alia, a bolt through one of a series of inline bolt apertures, a bolt through one of a series of apertures about an eccentric curve, a bolt providing one fixable point on an eccentric curve aperture, or a bolt providing one fixable point on an inclined slot aperture. In the preferred embodiment, the assembly includes one fixable point on an eccentric curve aperture in the form of a bolt through a washer bearing an eccentric slot adapted to rotate within a circular depression on the blade body.

The inventive apparatus permits pitch adjustment for various bucket teeth configurations and alignments, as well as a loosened configuration with the blade body slightly separated from the bucket front edge, so that the blade body is permitted to roll about the longitudinal axis. When loosened, the blade takes the contour of the ground that is hardest, and will scrape off the loose ground. The attachment allows the heavy equipment operator to grade side hills, V-ditches, and the like, without having to get off of the equipment to change the bucket and/or blade.

The inventive apparatus thus provides a removable blade that converts an excavation/backhoe bucket into a versatile tool for grading, mud clean-up, grass clearing, V-ditching, cut-back stripping and scraping asphalt or concrete curbs and gutters where the use of a loader is impractical. The apparatus is extremely durable, increases productivity, attaches with a single pin, requires no welding, and can be used on excavators, backhoes and bobcats.

The blade will fit any size bucket (e.g., twelve inches to thirty six inches) and either clamps onto the bucket, or attaches to the bucket with a through-bolt or pin, which requires the placement of a single hole through the bucket (and may be accomplished with a cutting torch or drill). The blade can be attached to the bucket with a single pin, enabling the user to change from digging to scraping in seconds. No special tools are required to attach the blade to the bucket. Additionally, the blade can be carried on the machine, simplifying the exchange process.

Since the blade covers the bucket teeth, the operator can excavate or grade without generating unwanted loose material, thereby avoiding required recompaction. Furthermore, the operator can extend the backhoe further and not have to "curl the bucket" during clean-up of finished asphalt and concrete.

Typical mounting instructions for the "pin" embodiment (requiring a hole in the bucket) are as follows:

1. Position the bucket with the teeth tilted slightly upward, lower all hydraulic equipment to the ground and turn the machine off.

2. The blade was designed to accommodate all buckets and including those with center mounted teeth. This is accomplished by moving the mounting attachment slightly (e.g., two inches) to the right or left of the center (the center of the blade is preferably marked for ease of mounting).

3. Before sliding the plate onto the bucket, insure that the lug on the adjustment ring is in the six o'clock position. Center the blade and position the U bracket (bucket clevis) onto the bucket making sure that both are fully engaged by tapping with a hammer.

4. Depending on whether the bucket teeth are new or worn determines which hole on the U bracket to mark; if they are new or extra long use the top hole, and if they are worn use the bottom hole. Carefully mark the appropriate hole and remove the blade.

5. Use a cutting torch or drill to make a seven-eighth inch to one inch hole through the bucket for the pin.

6. Mount the blade to the bucket by loosening the lug to the ten o'clock position, and fully insert the pin from the bottom and lock in place with the lynch pin.

7. Tighten the tension bolt to insure that the adjustment ring does not move.

8. To tighten the blade to the bucket, strike the adjustment ring lug counter-clockwise with a hammer. To remove the blade, strike the adjustment ring lug clockwise until it is loose and remove the lynch pin and pin.

9. For the floating position, the blade can pivot from side to side to match the contour of the grade. Depending on which bucket is used, the pivoting angle will change (e.g., the smaller the bucket, the greater the angle). To use the float position, loosen the adjustment ring lug by striking clockwise until the desired angle is reached.

The non-penetrating bolt clamp embodiment does not require a hole to be drilled through the bucket. Rather, a bolt or other fastener can be tightened down upon the bucket to provide adequate attachment.

A laterally extending depth gauge bracket enables the blade to be used to create measured trench depths. The bracket is adjustable up or down prior to trenching, and can be secured to the side of the blade by a bolt or other fastener.

BRIEF DESCRIPTION OF THE DRAWINGS

FIG. 3*a* is a side elevation cross-sectional view of one type of bucket tooth, while

DETAILED DESCRIPTION OF A PREFERRED EMBODIMENT

Figure 1:
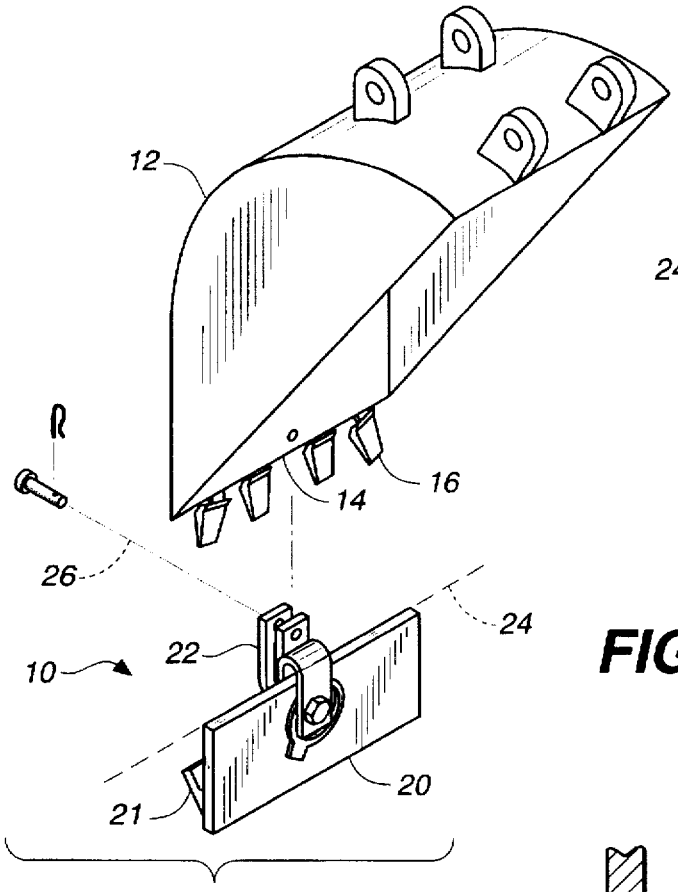
FIG. 1 is an exploded perspective view of the excavation bucket grading attachment of this invention, being installed to a typical backhoe bucket having a front edge bearing a plurality of bucket teeth, the grading attachment including a generally V-shaped blade body portion and a blade/bucket attachment assembly, together defining a blade lateral axis (along the width of the blade body portion at the connection with the bucket) and an equipment longitudinal axis (in line with the backhoe and bucket, and generally perpendicular to the blade lateral axis)

FIG. 1 is an exploded perspective view of the excavation bucket grading attachment 10 of this invention, being installed to a typical backhoe bucket 12 having a front edge 14 bearing a plurality of bucket teeth 16, the grading attachment 10 including a generally V-shaped blade body portion 20 having open ends 21 and a blade/bucket attachment assembly 22, together defining a blade lateral axis 24 (along the width of the blade body portion at the connection with the bucket) and an equipment longitudinal axis 26 (in line with the backhoe and bucket, and generally perpendicular to the blade lateral axis). The blade body portion 20 can be made in any width, e.g., one, one and-a-half, two and-a-half, three, four or five feet, as appropriate for given equipment or applications.

Figure 2:
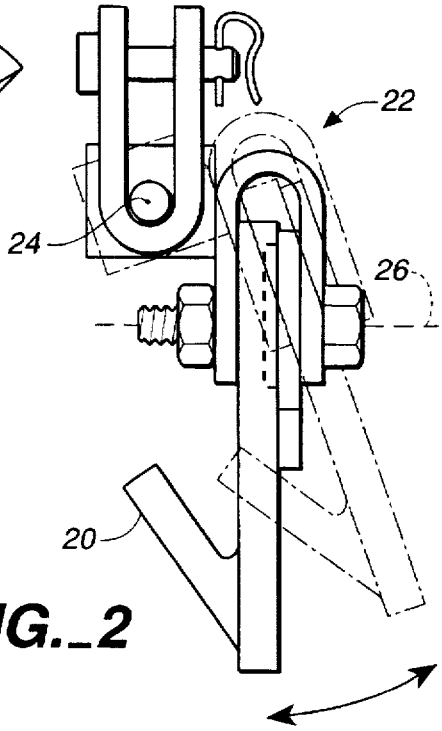
FIG. 2 is a side elevation view of the grading attachment blade body portion and blade/bucket attachment assembly, illustrating its ability for pitch adjustment for various bucket teeth configurations and alignments.

FIG. 2 is a side elevation view of the grading attachment blade body portion 20 and blade/bucket attachment assembly 22, illustrating its ability for pitch adjustment to accommodate various bucket teeth configurations and alignments. The blade body is permitted to adjust in pitch about the lateral axis (here, a line coming out of the page at point 24).

Figure 3A:
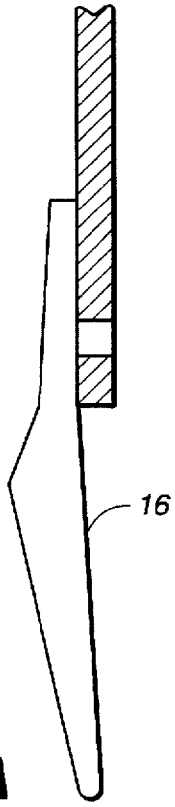
Figure 3B:
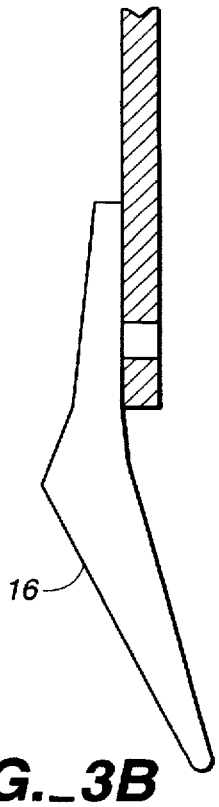
FIG. 3*b* illustrates an alternate tooth arrangement, either of which is accommodated by the pitch adjustment illustrated in FIG. 2.

FIG. 3*a* is a side elevation cross-sectional view of one type of bucket tooth 16, while FIG. 3*b* illustrates an alternate tooth arrangement 16, either of which is accommodated by the pitch adjustment illustrated in FIG. 2.

Figure 4A:
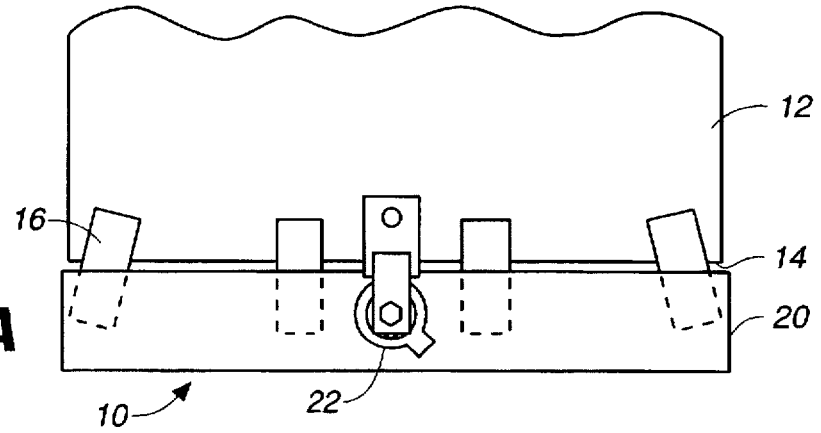
FIG. 4*a* is a cutaway front elevation view of the grading attachment of this invention as attached to a backhoe bucket, this view illustrating the blade/bucket attachment assembly in its tightened configuration with the blade body pulled tightly against the bucket front edge.
Figure 4B:
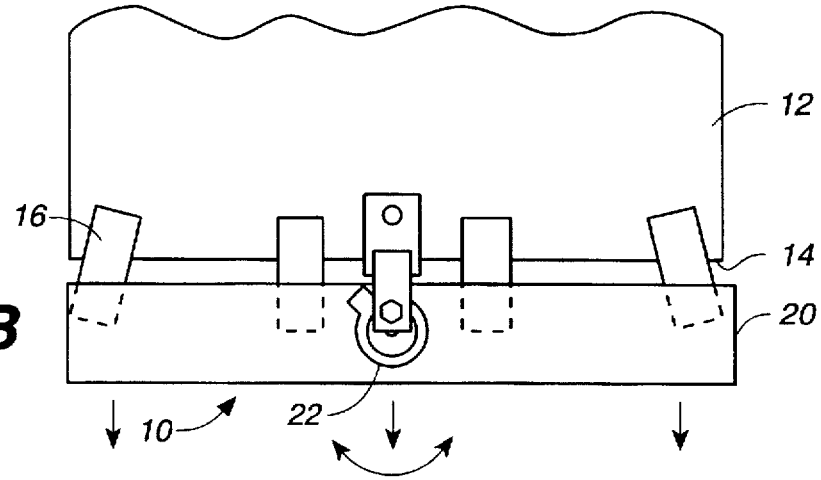
FIG. 4*b* is a cutaway front elevation view of the grading attachment of this invention as attached to a backhoe bucket, this view illustrating the blade/bucket attachment assembly in its loosened configuration with the blade body slightly separated from the bucket front edge.
Figure 4C:
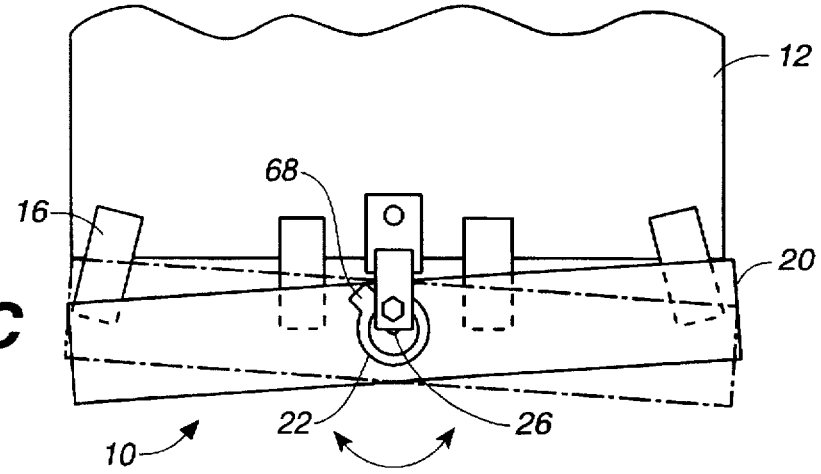
FIG. 4*c* is a cutaway front elevation view of the grading attachment of this invention as attached to a backhoe bucket, this view illustrating the blade/bucket attachment assembly in its loosened configuration with the blade body slightly separated from the bucket front edge and permitted to roll about the longitudinal axis (perpendicular to the page)

FIG. 4*a* is a cutaway front elevation view of the grading attachment 10 of this invention as attached to a backhoe bucket 12, this view illustrating the blade/bucket attachment assembly 22 in its tightened configuration with the blade body 20 pulled tightly against the bucket front edge 14. FIG. 4*b* illustrates the blade/bucket attachment assembly in its loosened configuration with the blade body 20 slightly separated from the bucket front edge 14. FIG. 4*c* illustrates the blade/bucket attachment assembly in its loosened configuration with the blade body 20 slightly separated from the bucket front edge 14 and permitted to roll about the longitudinal axis (perpendicular to the page at point 26). Adjustment between the loosened and tightened configurations can be accomplished from the cab of the backhoe, by striking the tab or flange 68 (see FIG. 6) with a hammer or other tool. As previously discussed, the loose configuration of FIG. 4*c* can be desirable, and can be used to naturally level a working surface.

Figure 5:
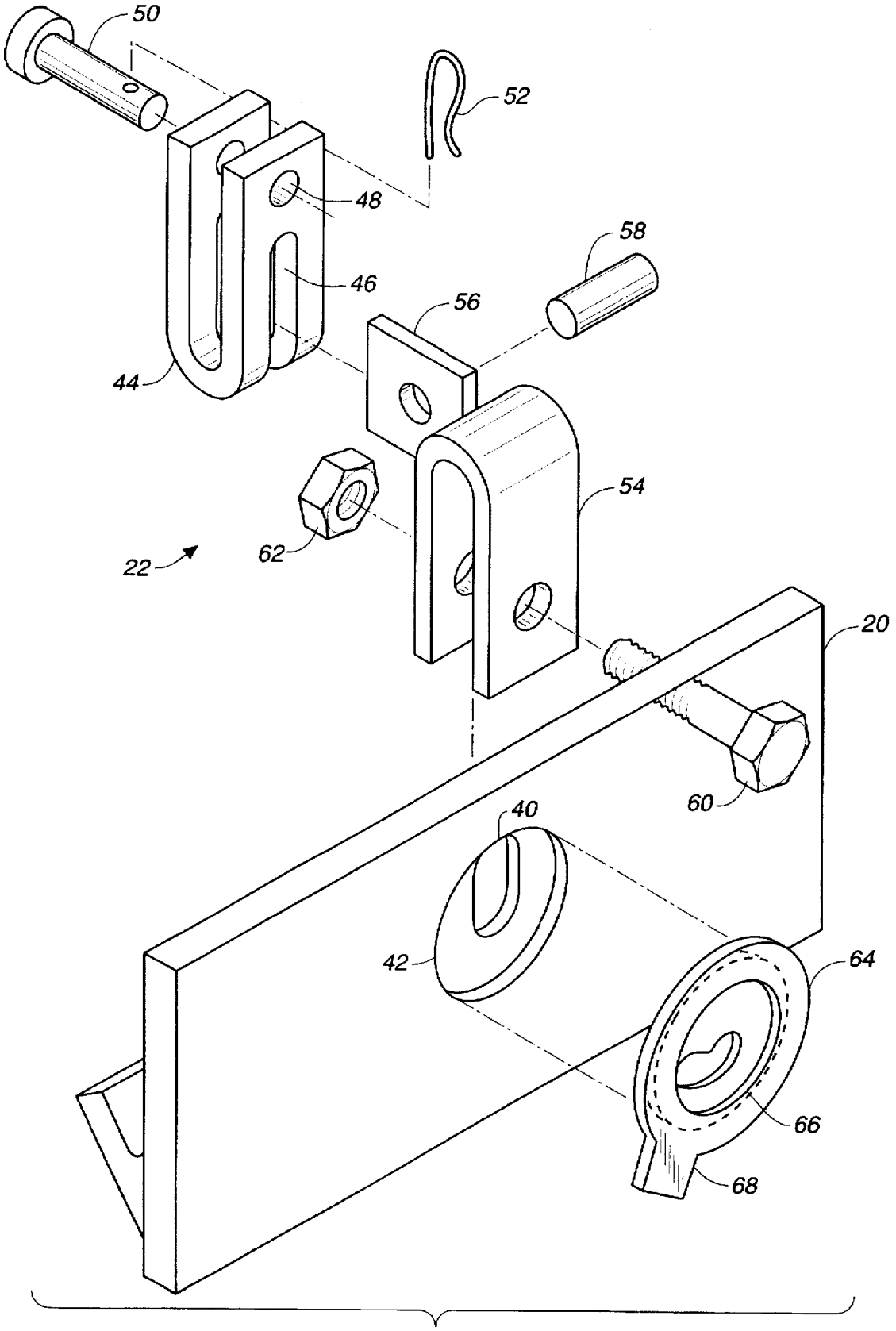
FIG. 5 is an exploded perspective view of the grading attachment blade body portion illustrating its generally V-shaped body portion bearing a bolt aperture and washer guide, and the blade/bucket attachment assembly, illustrating the component parts including an upper or bucket clevis member having a slot, and a plurality of pin holes for various bucket tooth depths, a bucket clevis pin and locking clip, and a lower or blade clevis member having a tab to engage the slot in the bucket clevis member and be retained there by a blade clevis pin, a bolt and nut for securing the blade clevis to the blade through the bolt aperture, and an eccentric blade washer member bearing a cam-shaped bolt guide adapted to rotate within the washer guide, and including a tab or flange for striking by a hammer or other tool to turn the eccentric.

FIG. 5 is an exploded perspective view of the grading attachment blade body portion 20 illustrating its generally V-shaped body portion bearing a vertically slotted bolt aperture 40 and generally circular recessed washer guide 42, and the blade/bucket attachment assembly 22, illustrating the component parts including an upper or bucket clevis member 44 having a slot 46, and a plurality of pin holes 48 for various bucket tooth depths, a bucket clevis pin 50 and locking clip 52, and a lower or blade clevis member 54 having a tab 56 to engage the slot 46 in the bucket clevis member 44 and be retained there by a blade clevis pin 58, a bolt 60 and nut 62 for securing the blade clevis 54 to the blade 20 through the bolt aperture 40, and an eccentric blade washer member 64 bearing an eccentric or cam-shaped bolt guide 66 adapted to rotate within the washer guide 42, and including a tab or flange 68 for striking by a hammer or other tool to turn the eccentric.

Figure 6B:
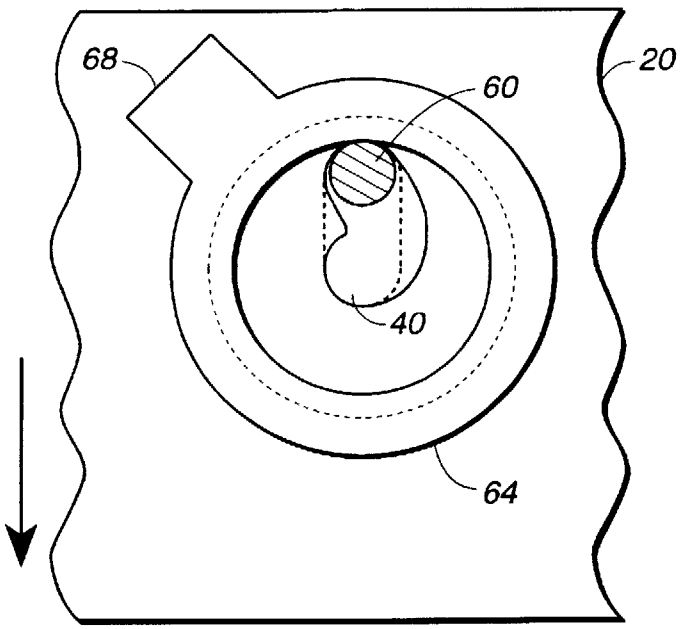
FIG. 6*b* is a cutaway front elevation view of a portion of the grading attachment of this invention as attached to a backhoe bucket, this view illustrating the blade/bucket attachment assembly in its loosened configuration with the eccentric blade washer member flange oriented in a position so that the bolt is generally radially off-center and the blade body is slightly separated from the bucket front edge.
Figure 6A:
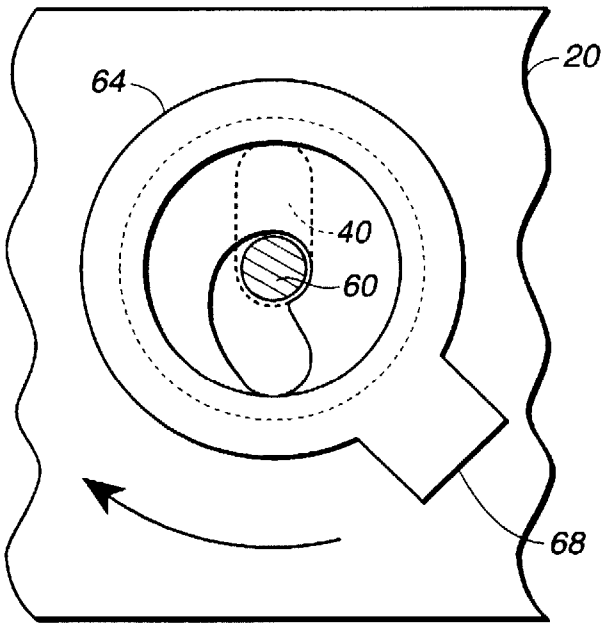
FIG. 6*a* is a cutaway front elevation view of a portion of the grading attachment of this invention as attached to a backhoe bucket, this view illustrating the blade/bucket attachment assembly in its tightened configuration with the eccentric blade washer member flange oriented in a position so that the bolt is generally centered and the blade body is tight against the bucket front edge.

FIG. 6*a* is a cutaway front elevation view of a portion of the grading attachment of this invention as attached to a backhoe bucket, this view illustrating the blade/bucket attachment assembly in its tightened configuration with the eccentric blade washer member flange 68 oriented in a position so that the bolt 60 is generally centered in the washer 64 and the blade body 20 is tight against the bucket front edge 14 (as in FIG. 4*a*).

FIG. 6*b* illustrates the blade/bucket attachment assembly in its loosened configuration with the eccentric blade washer member flange 68 oriented in a position so that the bolt 60 is generally radially off-center in the washer 64 and the blade body 20 is slightly separated from the bucket front edge 14 (as in FIGS. 4*b* and 4*c*).

Figure 7:
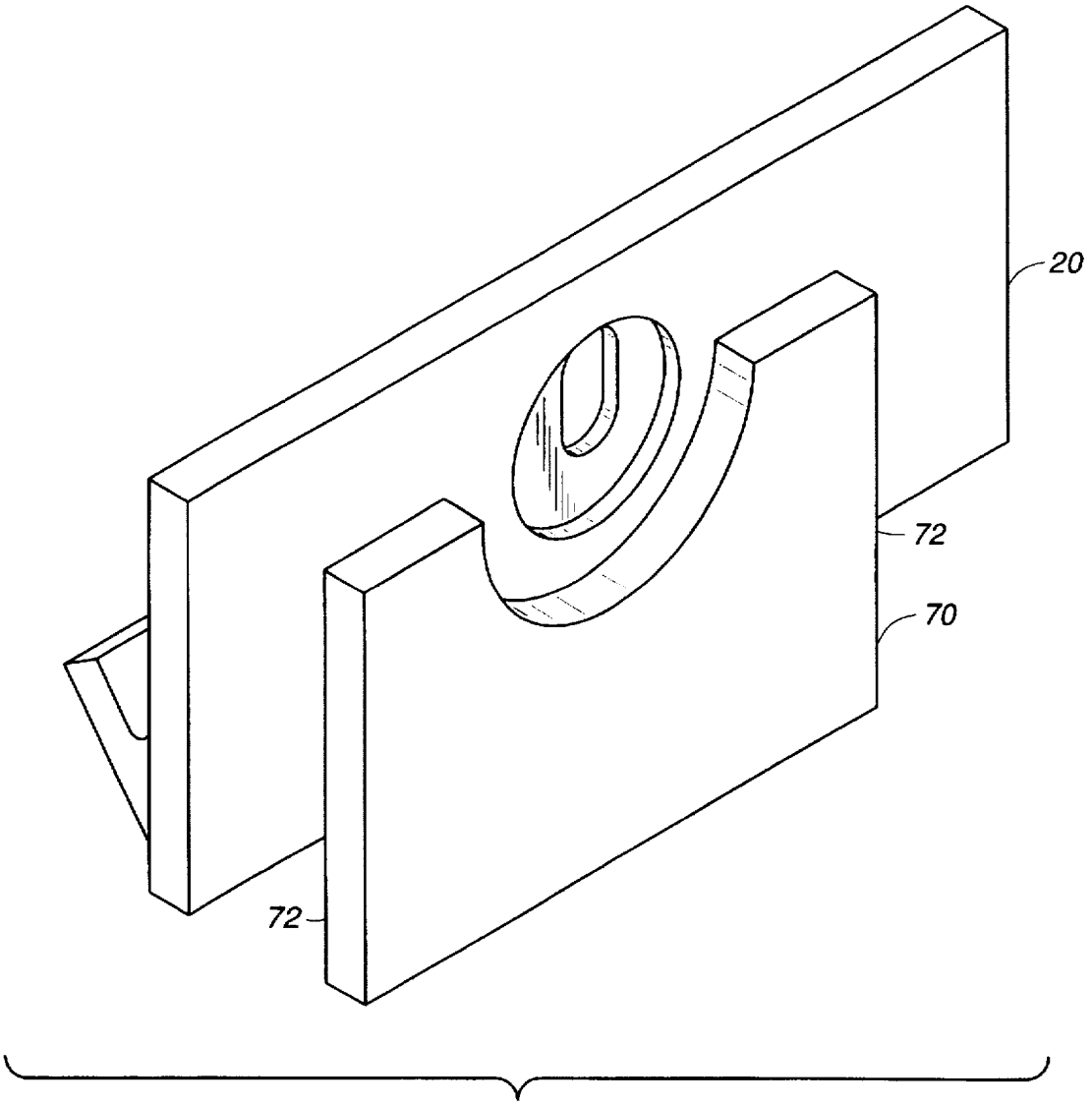
FIG. 7 is a perspective view of an optional cut-back gauge that may be releasably attached to the grading attachment blade body portion.

FIG. 7 is a perspective view of an optional cutback gauge 70 that may be releasably attached to the grading attachment body portion 20. This removable gauge or plate may be used, inter alia, to trench recycled asphalt or "cut-back". It may be fixed at varying cut depths relative to the blade 20 by use of one of several bolt apertures 72.

Figure 8:
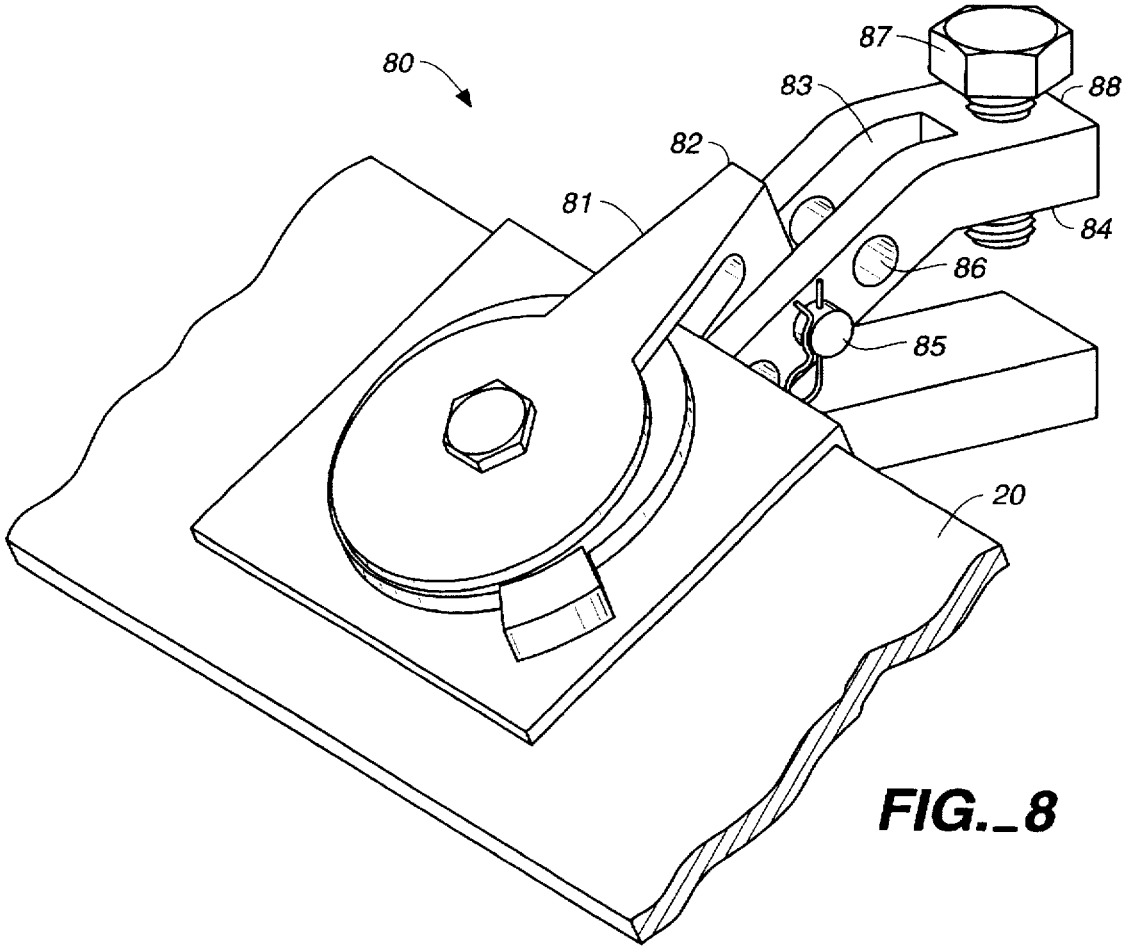
FIG. 8 is a perspective view of a modified blade/bucket attachment assembly, with a non-penetrating bolt clamp to secure the assembly to the bucket.

FIG. 8 is a perspective view of a modified blade/bucket attachment assembly 80. Blade clevis 81 extends around a portion of blade 20, such that blade clevis upper end 82 fits within and releasably engages slot 83 of bucket clevis 84, and is secured there by pin 85 through one of a plurality of apertures 86. Bolt 87 extends through only one side of bucket clevis upper end 88, such that it may be tightened down to securely clamp upon a bucket. Alternatively, the bolt 87 could be designed to pass through a hole cut or drilled in the bucket, and secured to the other side of the bucket clevis, in the manner described supra.

Figure 9:
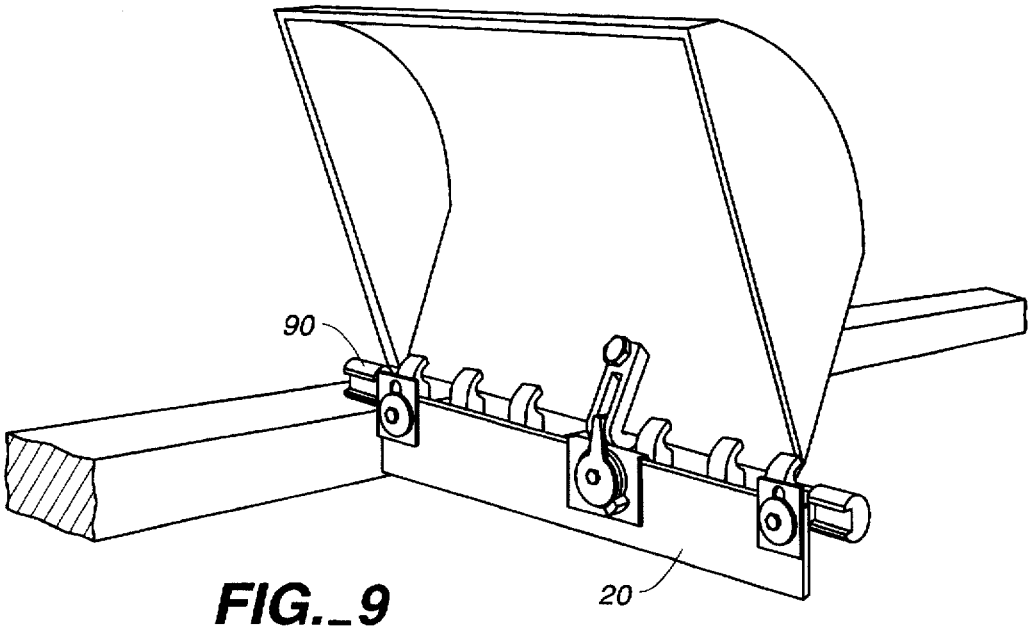
FIG. 9 is a perspective view of a laterally extending depth gauge bracket affixed to the side of the blade to enable measured trench depths.

FIG. 9 is a perspective view of a laterally extending depth gauge bracket 90 affixed to the side of a blade 20. One or a pair of these brackets may be welded, bolted, or otherwise secured on the ends of the grading attachment body portion, so that they define the higher surface, with the blade body defining the lower surface. The bracket can be run along the top of a curb, form or other guide on the working surface so that the blade body cuts a trench to a pre-determined depth (e.g., one inch to six inches).

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A grading attachment for releasable attachment to an excavation bucket, said excavation bucket having a front edge bearing a plurality of bucket teeth, said grading attachment comprising:

a generally V-shaped blade body portion having a width and adapted to fit over and accommodate said plurality of bucket teeth on said excavation bucket; and a blade/bucket attachment assembly connected to said blade body portion and adapted for releasable attachment to the front edge of the excavation bucket, said blade/bucket attachment assembly comprising a blade clevis adapted to extend around a portion of said blade body, said blade clevis having an upper end, a bucket clevis having a slot to releasably engage said blade clevis upper end, and a bolt adapted to extend through said bucket clevis to secure against said excavation bucket, said blade body portion and said blade/bucket attachment assembly together defining a blade lateral axis along the width of the blade body portion at the attachment to the excavation bucket, and a longitudinal axis in line with the excavation bucket and generally perpendicular to the blade lateral axis, said blade/bucket attachment assembly adapted for selective and releasable one-point adjustment of the relative distance between said excavation bucket front edge and said blade body portion, wherein when said blade/bucket attachment assembly is tightened said blade body portion is pulled tightly against the bucket front edge, and when said blade/bucket attachment assembly is loosened said blade body portion is separated from the bucket front edge and permitted to roll about said longitudinal axis.

2. The grading attachment for releasable attachment to an excavation bucket of claim 1 wherein said blade/bucket attachment assembly provides one fixable point on an eccentric curve and comprises a washer bearing an eccentric slot adapted to rotate within a circular depression on said blade body portion.

3. The grading attachment for releasable attachment to an excavation bucket of claim 1 wherein said blade body has an end including a laterally extending depth gauge bracket adapted to contact a surface and enables said blade body to cut a trench to a pre-determined depth.

* * * * *